US012760675B2

(12) United States Patent
Graf et al.

(10) Patent No.: US 12,760,675 B2
(45) Date of Patent: Oct. 13, 2026

(54) AIR SUPPLY TO AN INTERNAL COMBUSTION ENGINE AND METHOD AND DEVICE FOR DIAGNOSING AN AIR SUPPLY TO AN INTERNAL COMBUSTION ENGINE

(71) Applicant: Robert Bosch GmbH, Stuttgart (DE)

(72) Inventors: Benedikt Graf, Ludwigsburg (DE); Christian Disch, Wimsheim (DE); Conrad Bubeck, Esslingen (DE); Stefan Bauer, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 367 days.

(21) Appl. No.: 18/533,425

(22) Filed: Dec. 8, 2023

(65) Prior Publication Data

US 2024/0191645 A1 Jun. 13, 2024

(30) Foreign Application Priority Data

Dec. 13, 2022 (DE) ..... 102022213542.3

(51) Int. Cl.
*F01N 3/30* (2006.01)
*F01N 3/22* (2006.01)

(52) U.S. Cl.
CPC ..... *F01N 3/303* (2013.01); *F01N 3/22* (2013.01); *F01N 2550/14* (2013.01)

(58) Field of Classification Search
CPC . F01N 3/303; F01N 3/306; F01N 3/22; F01N 3/222; F01N 3/225; F01N 3/32; F01N 3/323; F01N 3/2033; F01N 2550/14; F02M 35/04; F02M 35/042; F02M 35/10386
See application file for complete search history.

(56) References Cited

U.S. PATENT DOCUMENTS

2004/0182079 A1 9/2004 Akao et al.
2006/0150617 A1* 7/2006 Nishimura ..... F01N 13/009 60/299
2015/0211733 A1* 7/2015 Shibuya ..... F23D 11/44 431/350

(Continued)

FOREIGN PATENT DOCUMENTS

DE 19508013 C1 3/1996
DE 19539938 A1 4/1997

(Continued)

*Primary Examiner* — Robert Clemente

(74) *Attorney, Agent, or Firm* — Norton Rose Fulbright US LLP

(57) ABSTRACT

An air supply to an internal combustion engine which includes at least one cylinder and a heater. A first air duct is provided for supplying air to the at least one cylinder of the internal combustion engine for operating the internal combustion engine, and a second air duct is provided for supplying air to a heater for heating an exhaust system of the internal combustion engine. The first and second air ducts are connected by a third air duct to an air filter, for providing filtered ambient air to the internal combustion engine. The first and second air ducts each have at least one control element for controlling the quantity of air flowing through. The first and third air ducts in each case have a mass flow sensor for measuring a mass of the air flowing through the corresponding air duct. Methods and devices for diagnosing the air supply are also described.

17 Claims, 2 Drawing Sheets

(56) References Cited

U.S. PATENT DOCUMENTS

| | | | | |
|---|---|---|---|---|
| 2016/0305302 | A1* | 10/2016 | Martin | F01N 3/103 |
| 2024/0191644 | A1* | 6/2024 | Graf | F01N 3/30 |
| 2024/0191646 | A1* | 6/2024 | Graf | F01N 3/225 |
| 2024/0287927 | A1* | 8/2024 | Graf | F01N 3/22 |
| 2024/0309822 | A1* | 9/2024 | Disch | F02M 35/10262 |

FOREIGN PATENT DOCUMENTS

| | | | |
|---|---|---|---|
| DE | 10344910 | A1 | 5/2004 |
| DE | 112008000132 | T5 | 11/2009 |
| DE | 102009000063 | A1 | 7/2010 |
| DE | 102012200444 | A1 | 7/2013 |
| DE | 112014001011 | T5 | 11/2015 |
| DE | 102020215289 | A1 | 6/2022 |
| EP | 2743470 | A1 | 6/2014 |

* cited by examiner

AIR SUPPLY TO AN INTERNAL COMBUSTION ENGINE AND METHOD AND DEVICE FOR DIAGNOSING AN AIR SUPPLY TO AN INTERNAL COMBUSTION ENGINE

CROSS REFERENCE

The present application claims the benefit under 35 U.S.C. § 119 of German Patent Application No. DE 10 2022 213 542.3 filed on Dec. 13, 2022, which is expressly incorporated herein by reference in its entirety.

FIELD

The present invention is based on an air supply to an internal combustion engine and a method and a device for diagnosing an air supply.

BACKGROUND INFORMATION

German Patent No. DE 195 08 013 C1 describes an air supply to an internal combustion engine in which a first air duct and a second air duct are provided. Air is supplied through the first air duct to cylinders of the internal combustion engine. Air is supplied via a second air duct to a heater for heating an exhaust system of the internal combustion engine.

SUMMARY

An air supply according to the present invention and the method and device for diagnosing an air supply with certain features of the present invention may have an advantage that, due to the novel assignment of the air ducts to cylinders and to a heater of the exhaust system of the internal combustion engine, novel and improved possibilities arise for diagnosis during ongoing operation. A mutual plausibility check and checking of the measured signals and thus a diagnosis of the entire air system can thus be carried out. In particular, leakages in the air supply, i.e., undesired ingress of air from the environment of the internal combustion engine into the air supply of the internal combustion engine, can thus be detected very reliably. The operational reliability of internal combustion engines is thus significantly increased. In addition to the advantages for diagnostic possibilities, in the air supply according to the present invention, only one air outlet of the two air paths at the air filter box needs to be taken into account. This is a particular advantage if for packaging reasons insufficient installation space for a second air outlet is provided. Since the second air outlet for the burner system does not have to be routed up to the air filter box, it can also be designed so as to be geometrically shorter.

Further advantages and improvements result from features of the present invention disclosed herein. According to an example embodiment of the present invention, a diagnostic possibility arises particularly easily if no air is flowing through the first air duct and then the mass flows through the third air duct are then compared to expected values of the flow through the second air duct. Alternatively, an expected value for a pressure in the air supply can also be formed depending on the flow through the second air duct. The expected values for the mass flow and the pressure thereby result from a control of an air pump and the opening of a valve flap in the second air duct. The leak-tightness of the air ducts can thus be checked. A further possibility of diagnosis arises in this operating state when the second sensor element checks a mass flow through the air duct 1. During correct operation, no mass flow should be measured at the sensor element 12 in the first air duct 1. A detected mass flow in the air duct 1 then points to a leak in the air supply or a defective throttle valve. Furthermore, in such operation, in which an air flow occurs only in the second air duct, a check can be made on the oxygen content in the exhaust gas of the heater. In the event of correct functioning, this should largely correspond to an expected value. During operation in which the control elements of the first and second air ducts are controlled such that there is an air flow in the first and second air ducts, the air flow in the second air duct is ascertained, by the measured mass flow of the first air duct being subtracted from the measured mass flow of the third air duct. A plausibility check of the mass flows through the first and second air ducts is then effected by a comparison to expected values. In this way, a simple diagnosis of the mass flows through the first and second air ducts can be carried out, and corresponding conclusions can be drawn about correct or faulty operation. If the control elements of the second air duct prevent an air flow, then in the case of correct operation, the flow through the first air duct and through the third air duct will be the same. This flow can then be compared to expected values which result from the operating data of the cylinders and of the actuating element in the first air duct. A correct or a faulty operation of the air supply can thus be differentiated.

BRIEF DESCRIPTION OF THE DRAWINGS

Exemplary embodiments of the present invention are illustrated in the figures and explained in more detail in the description below.

FIG. 2 shows an air system of an internal combustion engine in which air is being supplied to the cylinders of the internal combustion engine, and a heater for heating the exhaust gas system of the internal combustion engine is switched on.

FIG. 3 shows an air system of an internal combustion engine in which air is being supplied to the cylinders of the internal combustion engine, and a heater for heating the exhaust gas system of the internal combustion engine is not switched on.

DETAILED DESCRIPTION OF EXAMPLE EMBODIMENTS

Figure 1:
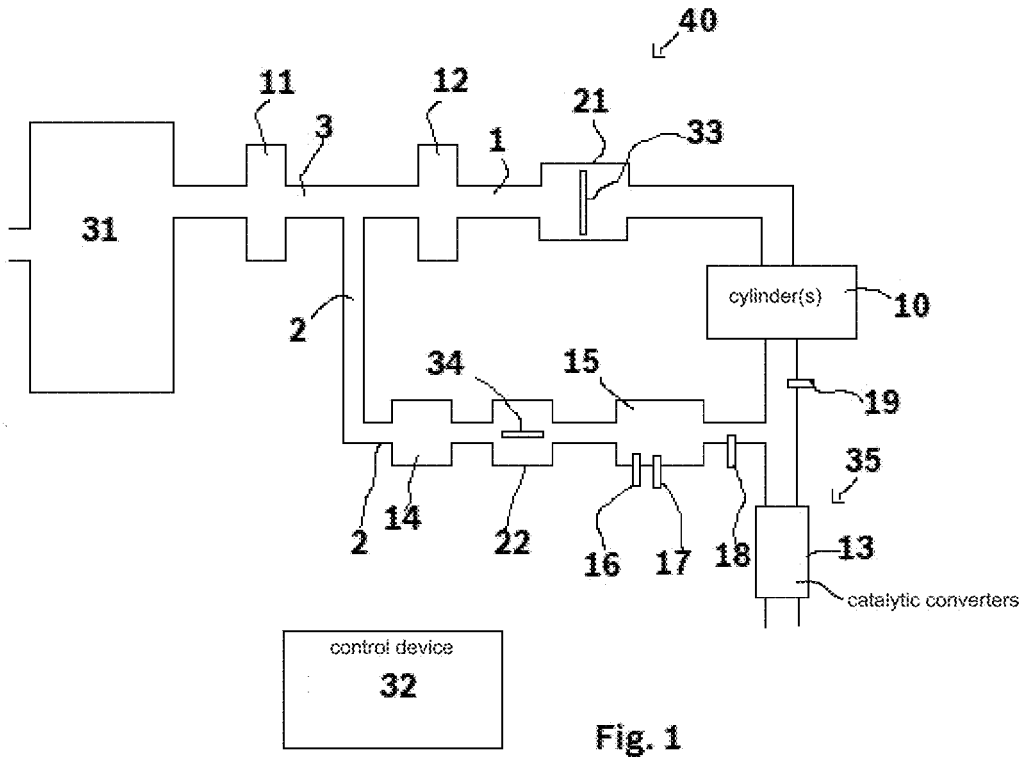
FIG. 1 shows an air system in which no air is being supplied to the cylinders of the internal combustion engine and a heater of the exhaust system is switched.

FIG. 1 schematically shows an internal combustion engine 40 with an air supply with a first air duct 1 and a second air duct 2. The air duct 1 is connected to an air filter 31 via a third air duct 3. The air duct 2 is likewise connected to the air filter 31 via the air duct 3. The air filter 31 filters ambient air and provides the filtered ambient air for the operation of the internal combustion engine 40, not only for the cylinders 10 but also for the heater 15.

A sensor element 11 is arranged in the third air duct 3. In the first air duct 1, starting from the air duct 3, a sensor element 12, a throttle valve 21, and then at least one cylinder 10 are arranged. Starting from the air duct 3, an air pump 14, a shut-off valve 22 and then a heater 15 are arranged in the second air duct 2.

The two sensor elements 11, 12 each have a mass flow sensor. The mass flow sensor measures the mass of air that flows through the relevant air duct 1, 3. Furthermore, a pressure sensor and a temperature sensor can also be provided in each case in the sensor elements 11, 12. The pressure in the air ducts 1, 3 is measured in each case by pressure sensors. The temperature of the air flowing through the air ducts 1, 3 is measured in each case by the temperature sensors.

The mass of air which is sucked in by the cylinders 10 and thus flows through the air duct 1 is controlled by the throttle valve 21. For this purpose, a valve flap 33 is actuated in such a way that it controls the air flow. FIG. 1 schematically shows a position of the valve flap 33 transverse to the air flow, which represents a closed valve flap 33 and thus no flow through the air duct 1. However, the valve flap 33 can also assume intermediate positions between open and closed, by means of which the amount of air that is sucked in by the cylinders 10 of the internal combustion engine 40 is controlled.

The amount of air flowing through the air duct 2 is determined by the air pump 14 and the shut-off valve 22. Only when the air pump 14 is switched on is a negative pressure generated which leads to a flow in the second air duct 2. Furthermore, the amount of air flowing through the air duct 2 can be influenced depending on the position of a valve flap 34 of the shut-off valve 22. The amount of air can be influenced by the delivery rate of the air pump 14 and the position of the valve flap 34. In a particularly simple embodiment, the valve flap 34 can only assume the completely open position or the completely closed position, and the air quantity is controlled only by the delivery rate or rotational speed of the air pump 14. In the representation in FIG. 1, the valve flap 34 is arranged longitudinally or in a laminar manner relative to the air flow, which corresponds to a fully open shut-off valve 22. In the representation in FIG. 1, an air flow through the air duct 2 toward the heater 15 is thus provided.

The cylinders 10 and the heater 15 are each connected to an exhaust system 35 so that the exhaust gases of the cylinders 10 and of the heater 15 are routed through the exhaust system 35. Catalytic converters 13 and at least one lambda sensor 19 are provided in the exhaust system 35. The catalytic converters 13 may have a plurality of partial catalytic converters, for example a first and a second three-way catalytic converter, a particle filter, and a catalytic converter for NOx reduction. The precise function and arrangement of the partial catalytic converters is not important for understanding the present invention. The residual oxygen content in the exhaust gas is determined by the lambda sensor 19. It can thus be ensured that the total quantity of fuel introduced into the cylinders 10 and the heater 15 is in a stoichiometric ratio to the introduced air, since only in such an operating range is good cleaning of the exhaust gas ensured.

The heater 15 comprises a fuel injector 16 and an igniter 17. The fuel injector 16 is designed as a conventional fuel injection valve and enables a precisely defined quantity of fuel to be introduced into the heater 15 for a heating operation. The igniter 17 is typically designed as a spark plug or as a glow plug for igniting a fuel/air mixture. A further lambda sensor 18 can optionally also be arranged in the connecting pipe between the heater 15 and the exhaust system 35, by means of which further lambda sensor it can be ensured that the quantity ratios of air and fuel in the heater 15 also correspond to a desired setpoint value.

Typically, the heater 15 is switched on before the internal combustion engine 40 is started or during an early operating phase of the internal combustion engine. For example, the start of an internal combustion engine can be delayed and initially only an operation of the heater 15 take place. A heating of the exhaust system 35 is thus already achieved before the start of an internal combustion engine. As a result of this measure, cleaning of the exhaust gas is already enabled in early operation of the internal combustion engine, since it is not necessary to wait until the exhaust gases of the cylinders 10 reach the operating temperature of the catalytic converters 13 for converting the exhaust gases in the exhaust system 35. A start of the internal combustion engine is therefore delayed for a short time (for example 1 to 10 seconds) in order to ensure a minimum temperature of the exhaust system at start-up of the internal combustion engine. Typically, a second operating phase is then carried out in which the internal combustion engine is already being operated by combustion processes in the cylinders 10 and, at the same time, heating by the heater 15 is also taking place. A further rapid heating of the exhaust system 35 up to an optimal operating temperature of the catalytic converters 13 is thereby ensured. In a third continuous operation of the combustion in the cylinders 15, it is possible for the heater 15 then not to be operated further. If operating phases occur with insufficient heat introduction into the exhaust system 35 during further operation of the internal combustion engine, the heater 15 can be activated again.

For controlling and diagnosing the device according to FIG. 1, a control device 32 is provided which (via lines not shown here) receives signals from all sensors and sends signals for controlling all control elements. The control device 32 processes the sensor signals and calculates control signals for the control element. Accordingly, the diagnostic functions described below are executed by the control device 32. The control device 32 can also be a part of a large control device which can perform a wide variety of control tasks for the operation of the internal combustion engine or of a vehicle in which the internal combustion engine is installed.

In FIG. 1, the throttle valve 21 is closed and the air pump 14 is activated, and the shut-off valve 22 is open. FIG. 1 thus shows an operating state in which the cylinders 10 of the internal combustion engine are not in operation and thus no air is flowing through the air duct 1 to the cylinders 10. In contrast, the shut-off valve 22 is open and the air pump 14 is activated. This operating state thus corresponds to a heating of the exhaust system 35 with no combustion taking place in the cylinders 10. This is the case, for example, in an upstream heating operation of the exhaust system 35 before the internal combustion engine is started, for example during a cold start.

Since no air is flowing through the air duct 1, in the case of correct operation, the mass flow through the sensor element 11 corresponds to the mass flow through the air duct 2. A first simple diagnosis therefore compares the mass flows through the air duct 3 to an expected value for the flow through the air duct 2. Since the flow through the air duct 2 in its entirety also flows through the air duct 3, the measurement value for the mass flow of the sensor element 11 through the air duct 3 thus indicates the flow of air through the air duct 2. The expected value results from the control of the air pump 14 and, if applicable, from the opening of the valve 22 or from the position of the valve flap 34. If the flow through the air duct 2 is controlled not only by the operating data of the air pump 14 but also by the position of the valve flap 34, both values will have to be taken into account for the formation of an expected value. If the flow through the air duct 2 is defined only by the operating data of the air pump 14, in particular a delivery rate or rotational speed, then only the operating data of the air pump will have to be taken into account for the formation of an expected value. If it is then determined that the mass flow through the air duct 3 does not correspond to the expected value or the deviation from the expected value is too large, a fault in the air supply will be detected. Such a fault can consist, for example, in a leak of one of the air ducts 1, 2, 3 toward the ambient air, a fault in the pump 14, or a malfunction in the valve 22.

The operation of the internal combustion engine 40, as shown in FIG. 1, also makes possible a further diagnosis if a pressure sensor is present in the sensor element 11 or also in the sensor element 12. Depending on the flow through the air duct 2, a pressure is set in the air supply upstream of the pump 14. An expected value for the pressure upstream of the air pump 14 results from the control of the air pump 14 and, if applicable, from the opening of the valve 22 or from the position of the valve flap 34. If the flow through the air duct 2 is controlled not only by the operating data of the air pump 14 but also by the position of the valve flap 34, both values will have to be taken into account for the formation of an expected value. If the flow through the air duct 2 is defined only by the operating data of the air pump 14, in particular a delivery rate or rotational speed, then only the operating data of the air pump will have to be taken into account for the formation of an expected value. This expected value for the pressure upstream of the air pump 14 is then compared to corresponding measured values for the pressure of the sensor element 11 or of the sensor element 12. The two pressure values then have to correspond to one another and correspond to the expected value for the pressure. If this is not the case, the cause of this deviation can be a fault in the air supply, in particular a leak relative to the ambient air.

The operation of the internal combustion engine 40, as shown in FIG. 1, also makes possible a further diagnosis by evaluating a signal of a mass flow in the sensor element 12 in the first air duct 1. In the fault-free case the closed throttle valve 21 ensures that no flow of air takes place in the first air duct 1. If an air flow is nevertheless measured by the mass flow sensor of the sensor element 12 in the first air duct 1, it can be concluded that there is a leak in the first air duct 1. This form of diagnosis thus makes it possible to determine whether a leak is present in the first air duct 1 between the throttle valve 21 and the connection to the second air duct 2. Furthermore, it could also be detected whether the throttle valve 21 is closing reliably, or whether exhaust gas is possibly being sucked back via the air duct 1 via the cylinder 10.

The operation of the internal combustion engine 40, as shown in FIG. 1, also makes possible a further diagnosis using the lambda sensor 18 or the lambda sensor 19. During operation according to FIG. 1, in which only the heater 15 is being operated, a disturbance of the ratio of air and fuel in the heater 15 would have a direct effect on the oxygen content of the exhaust gas of the heater 15. The aim is an operation in which air and fuel are introduced into the heater 15 in a stoichiometric ratio, i.e. the same amount of oxygen is available as is required for the combustion of the introduced fuel. A deviation from this can in particular give an indication of a leak in the air duct 2 or an insufficient amount of fuel that has been injected into the heater 15.

In the same way, deviations from desired sub- and super-stoichiometric operating phases can also be diagnosed If a pressure sensor is additionally arranged in one of the sensor elements 11 or 12, it will be possible to detect a successful start of heating by the heater 15. Fuel is introduced into the heater 15 via the injection valve 16 and combustion is started by the spark plugs 17. The beginning of heat release in the heater 15 results in a pressure wave which propagates through the air duct 2 into the air duct 1 and into the air duct 3 up to the air filter 31. This pressure wave can be detected by a corresponding pressure sensor in the sensor elements 11 or 12, and thus makes it possible to check the successful start-up of the heater 15.

Figure 2:
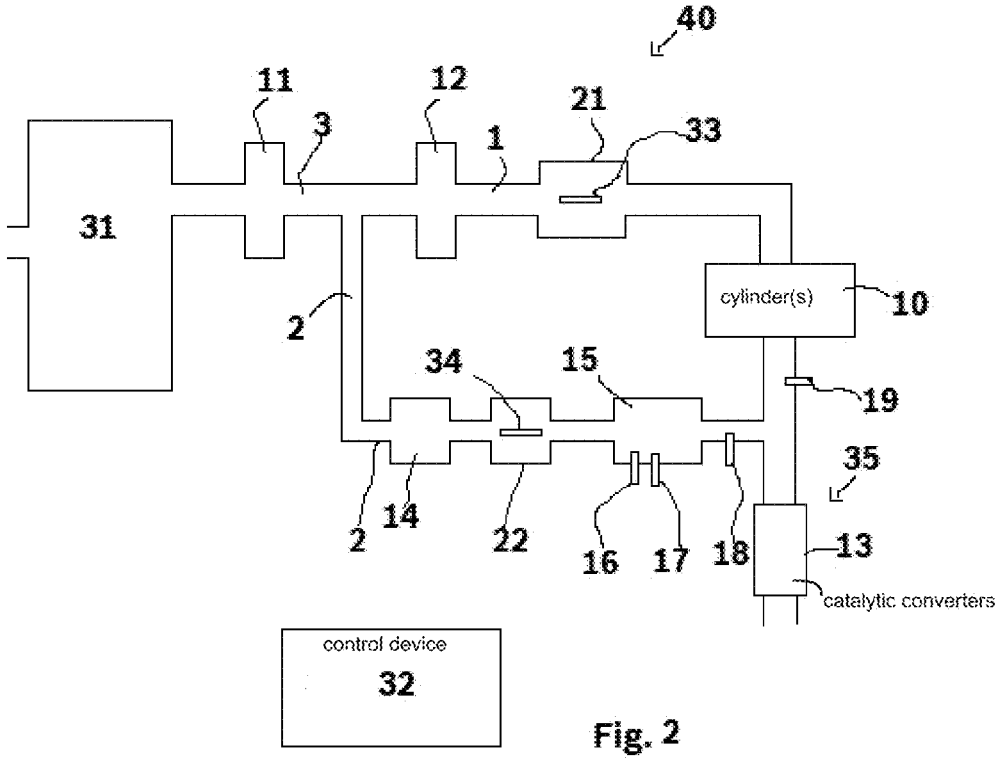

FIG. 2 shows an internal combustion engine 40 with all elements, as has already been described for FIG. 1. In contrast to FIG. 1, however, the valve plate 33 of the throttle valve 21 is shown open and the valve plate 34 of the shut-off valve 22 is also shown open. This is therefore a second operating state of the internal combustion engine 40 in which the cylinders 10 and the heater 15 are simultaneously supplied with air. Such an operating state is useful for achieving a further heating of the exhaust system 35 up to an optimal operating temperature for the catalytic converters 13. After a first heating of the exhaust system 35 to a minimum temperature from which the catalytic converters 13 operate, a further heating up to the optimal temperature is effected by a simultaneous heating with exhaust gases of the cylinders 10 and of the heater 15. Furthermore, such an operating state can make sense if only a small amount of heat is introduced by the cylinders 10 into the exhaust system 35 during normal operation. This can be the case, for example, in the case of a longer drive downhill when only small amounts of fuel are introduced into the cylinders 10.

In this second operating state too, a diagnosis can also be made by checking the signals of the mass flow of the sensor elements 11, 12. For this purpose, the mass flow of air through the air duct 2 to the heater 15 must first be determined. This takes place by subtracting the measured signal of the mass flow sensor of the sensor element 12 from the measured signal of the mass flow sensor of the sensor element 11. The mass flow sensor of the sensor element 11 measures the mass flow of air that flows not only through the air duct 1 but also through the air duct 2. The mass flow of air through the air duct 1 is then compared to an expected value, and in addition the mass flow of air through the air duct 2 is compared to a second expected value. The expected value for the mass flow through the air duct 1 results from the operating parameters of the cylinders 10, for example the rotational speed of the internal combustion engine and load, and from the operating data of the throttle valve 21, for example the position of the valve plate 33 in the throttle valve 21. The expected value for the mass flow through the air duct 2 results from the operating parameters of the air pump 14 and the valve 22. By comparing the expected values to the measured values, possibly measured faults can be assigned to the individual air ducts.

Figure 3:
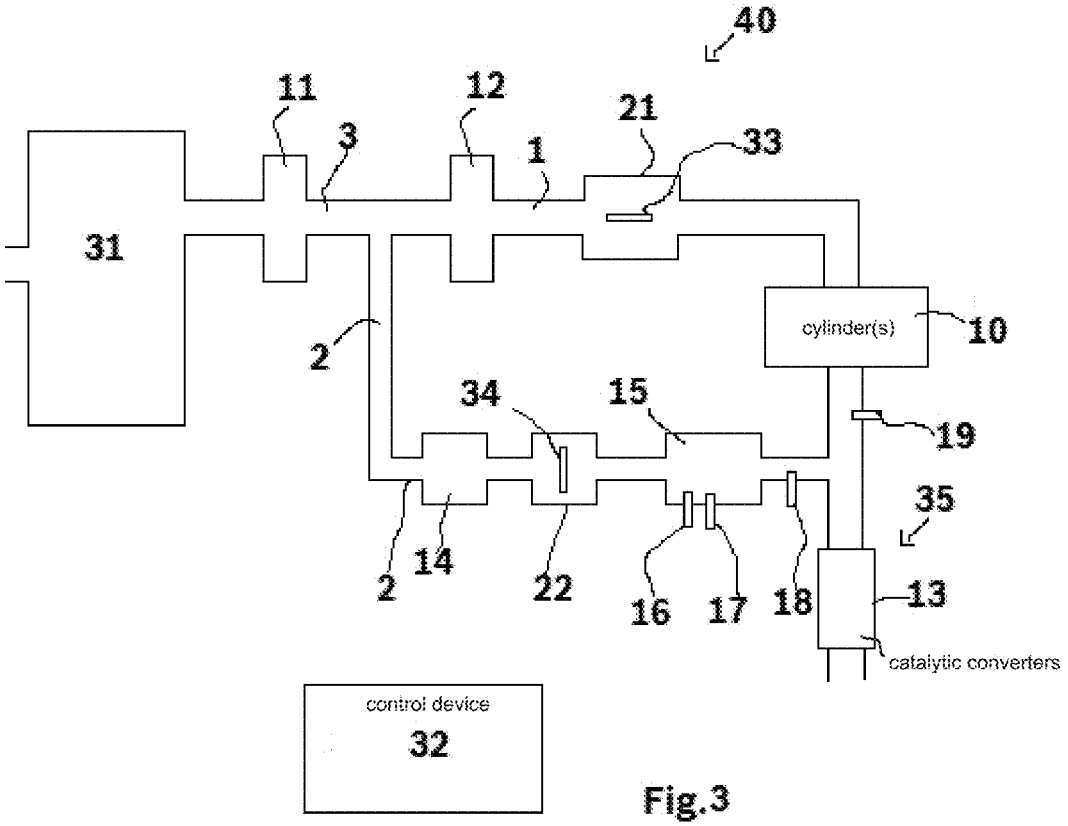

FIG. 3 shows an internal combustion engine 40 with all elements, as has already been described for FIG. 1 or 2. In contrast to FIG. 1, however, the valve plate 33 of the throttle valve 21 is shown open and the valve plate 34 of the shut-off valve 22 is shown closed. This is therefore a third operating state of the internal combustion engine 40 in which the cylinders 10 are supplied with air and the heater 15 is not in operation. This is therefore a normal operation of the internal combustion engine 40, without additional heating provided by the heater 15. Since during fault-free operation there is no air flowing through the air duct 2, the sensor elements 11, 12 measure the mass flow of the air which is supplied to the cylinders 10 for combustion. A simple diagnosis can thus be made by comparing the measured mass flows of the sensor elements 11, 12 to one another. In the case of a fault-free air supply, the two sensor elements 11, 12 indicate, disregarding measurement tolerances, the same value for mass flow. In the event of a leak in the air supply, in particular between the two sensor elements 11, 12 or in the air duct 2, more air will be sucked in through the air duct 1 than is flowing through the air duct 3. Different measured values of the mass flow of the sensor elements 11, 12 then occur, which leads to a corresponding diagnostic result.

Furthermore, in the operation as shown in FIG. 3, a plausibility check of the measured mass flows can of course be compared to expected values for the air requirement of the cylinders 10. The expected value for the mass flow through the air duct 1 results from the operating parameters of the cylinders 10, for example the rotational speed of the internal combustion engine and load, and from the operating data of the throttle valve 21, for example the position of the valve plate 33 in the throttle valve 21. A comparison of the measured air flows through the air duct 1 or 3 to the expected value for the mass flow through the air duct 1 can thus likewise be used for a diagnosis.

The present invention includes the following embodiments described in the numbered paragraphs below:

Paragraph 1. Air supply to an internal combustion engine (40) which has at least one cylinder (10) and a heater (15) of an exhaust system (35), comprising a first air duct (1) for supplying air to the at least one cylinder (10) of the internal combustion engine (40) for operating the internal combustion engine (40) and a second air duct (2) for supplying air to a heater (15) for heating an exhaust gas system (35) of the internal combustion engine (40), characterized in that the first and the second air ducts (1, 2) are connected by a third air duct (3) with an air filter, for providing filtered ambient air to the internal combustion engine (40), in that the first and the second air ducts (1, 2) each have at least one control element (21, 14, 22) for controlling the quantity of air flowing through, and in that the first and the third air ducts (1, 3) in each case have a mass flow sensor for measuring a mass of the air flowing through the corresponding air duct (1, 3).

Paragraph 2. Method for diagnosing an air supply according to Paragraph 1, characterized in that, in a first operating phase of the air supply, the control element (21) is closed in the first air duct (1) so that no air flows through the first air duct (1), in that the control element (14, 22) in the second air duct (2) is controlled such that air flows through the second air duct (2) for the operation of the heater (15), and for the diagnosis a mass flow through the third air duct (3) is compared to an expected value which results from the control of the air pump (14) and the opening of the valve (22).

Paragraph 3. Method for diagnosing an air supply according to Paragraph 1, characterized in that, in a first operating phase of the air supply, the control element (21) in the first air duct (1) is closed so that no air flows through the first air duct (1), in that the control element (14, 22) in the second air duct (2) is controlled such that air for the operation of the heater (15) flows through the second air duct (2), and for the diagnosis a pressure signal in the first or third air duct (1, 3) is compared to an expected value which results from the control of the air pump (14) and the opening of the valve (22).

Paragraph 4. Method for diagnosing an air supply according to Paragraph 1, characterized in that, in a first operating phase of the air supply, the control element (21) in the first air duct (1) is closed so that no air flows through the first air duct (1), in that the control element (14, 22) in the second air duct (2) is controlled such that air for the operation of the heater (15) flows through the second air duct (2), and for the diagnosis a mass flow in the first air duct (1) is measured, and in that a fault is detected when a mass flow is measured in the first air duct (1) despite the closed control element (21).

Paragraph 5. Method for diagnosing an air supply according to Paragraph 1, characterized in that, in a first operating phase of the air supply, the control element (21) in the first air duct (1) is closed so that no air flows through the first air duct (1), in that the control element (14, 22) in the second air duct (2) is controlled such that air for the operation of the heater (15) flows through the second air duct (2), and in that downstream of the heater (15) an oxygen content is measured in the exhaust gas of the heater (15) and is compared to an expected value for the diagnosis.

Paragraph 6. Method for diagnosing an air supply according to Paragraph 1, characterized in that, in a second operating phase of the air supply, the control element (21) in the first air duct (1) is open so that air flows through the first air duct (1) to the at least one cylinder (10), in that the control element (14, 22) in the second air duct (2) is controlled such that air for the operation of the heater flows through the second air duct (2), due to an air pump (14) of the control element being switched on and a valve (22) of the control element being open, in that the mass flow through the first air duct (1) is subtracted from the mass flow through the third air duct (3) in order to ascertain the mass flow through the second air duct (2) and in that the mass flows through the first and second air ducts (2) are compared to expected values ascertained from operating data of the cylinders (10) and the control elements in the first and second air ducts (1, 2).

Paragraph 7. Method for diagnosing an air supply according to Paragraph 1, characterized in that, in a third operating phase of the air supply, the control element (21) in the first air duct (1) is open so that air flows through the first air duct (1) to the at least one cylinder (10), in that the control element (14, 22) in the second air duct (2) is controlled such that no air for the operation of the heater flows through the second air duct (2), due to an air pump (14) of the control element being switched off and a valve (22) of the control element being closed, and in that for the diagnosis a mass flow through the first air duct (1) is compared to a mass flow through the third air duct (3).

Paragraph 8. Method for diagnosing an air supply according to Paragraph 1, characterized in that, in a third operating phase of the air supply, the control element (21) in the first air duct (1) is open so that air flows through the first air duct (1) to the at least one cylinder (10), in that the control element (14, 22) in the second air duct (2) is controlled such that no air for the operation of the heater flows through the second air duct (2), due to an air pump (14) of the control element being switched off and a valve (22) of the control element being closed, and in that for the diagnosis a mass flow through the first air duct (1) is compared to an expected value for the flow in the first air duct (1), which expected value results from the operating parameters of the cylinders (10), for example the rotational speed and load of the internal combustion engine (40), and from the operating data of the throttle valve (21).

Paragraph 9. Device for diagnosing an air supply according to Paragraph 1, characterized in that, in a first operating phase of the air supply in which the control element (21) in the first air duct (1) is closed so that no air flows through the first air duct (1), the control element (14, 22) in the second air duct (2) is controlled such that air for the operation of the heater (15) flows through the second air duct (2), and in that means are provided which for the diagnosis compare a mass flow through the third air duct (3) to an expected value which results from the control of the air pump (14) and from the opening of the valve (22).

Paragraph 10. Device for diagnosing an air supply according to Paragraph 1, characterized in that, in a first operating phase of the air supply in which the control element (21) in the first air duct (1) is closed so that no air flows through the first air duct (1), the control element (14, 22) in the second air duct (2) is controlled such that air for the operation of the heater (15) flows through the second air duct (2), and in that means are provided which for the diagnosis compare a pressure signal in the first or third air duct (1, 3) to an expected value which results from the control of the air pump (14) and from the opening of the valve (22).

Paragraph 11. Device for diagnosing an air supply according to Paragraph 1, characterized in that, in a first operating phase of the air supply in which the control element (21) in the first air duct (1) is closed so that no air flows through the first air duct (1), the control element (14, 22) in the second air duct (2) is controlled such that air for the operation of the heater (15) flows through the second air duct (2), and in that means are provided which for the diagnosis measure a mass flow in the first air duct (1) and detect a fault when a mass flow is measured in the first air duct (1) despite the closed control element (21).

Paragraph 12. Device for diagnosing an air supply according to Paragraph 1, characterized in that, in a first operating phase of the air supply in which the control element (21) in the first air duct (1) is closed so that no air flows through the first air duct (1), the control element (14, 22) in the second air duct (2) is controlled such that air for the operation of the heater (15) flows through the second air duct (2), and in that means are provided downstream of the heater (15) which measure an oxygen content in the exhaust gas of the heater (15) and compare it to an expected value for the diagnosis.

Paragraph 13. Device for diagnosing an air supply according to Paragraph 1, characterized in that, in a second operating phase of the air supply in which the control element (21) in the first air duct (1) is open so that air flows through the first air duct (1) to the at least one cylinder (10), the control element (14, 22) in the second air duct (2) is controlled such that air for the operation of the heater flows through the second air duct (2), due to an air pump (14) of the control element being switched on and a valve (22) of the control element being open, in that means are provided which are used to subtract the mass flow through the first air duct (1) from the mass flow through the third air duct (3) in order to ascertain the mass flow through the second air duct (2) and for the diagnosis compare the mass flows through the first and second air ducts (1, 2) to expected values ascertained from operating data of the cylinders (10) and of the control elements in the first and second air ducts (1, 2).

Paragraph 14. Device for diagnosing an air supply according to Paragraph 1, characterized in that, in a third operating phase of the air supply in which the control element (21) in the first air duct (1) is open so that air flows through the first air duct (1) to the at least one cylinder (10), the control element (14, 22) in the second air duct (2) is controlled such that no air for the operation of the heater flows through the second air duct (2), due to an air pump (14) of the control element being switched off and a valve (22) of the control element being closed, and in that means are provided for the diagnosis which compare a mass flow through the first air duct (1) to a mass flow through the third air duct (3).

Paragraph 15. Device for diagnosing an air supply according to Paragraph 1, characterized in that, in a third operating phase of the air supply in which the control element (21) in the first air duct (1) is open so that air flows through the first air duct (1) to the at least one cylinder (10), the control element (14, 22) in the second air duct (2) is controlled such that no air for the operation of the heater flows through the second air duct (2), due to an air pump (14) of the control element being switched off and a valve (22) of the control element being closed, and in that means are provided for the diagnosis which compare a mass flow through the first air duct (1) to an expected value for the flow in the first air duct (1), which expected value results from the operating parameters of the cylinders (10), for example the rotational speed and load of the internal combustion engine (40), and from the operating data of the throttle valve (21).

What is claimed is:

1. An air supply to an internal combustion engine which has at least one cylinder and a heater of an exhaust system, the air supply comprising:

a first air duct configured to supply air to the at least one cylinder of the internal combustion engine for operating the internal combustion engine; and a second air duct configured to supply air to a heater configured to heat an exhaust gas system of the internal combustion engine, wherein the first and second air ducts are connected to an air filter by a third air duct, for providing filtered ambient air to the internal combustion engine, each respective air duct of the first and the second air ducts having at least one control element for controlling a quantity of air flowing through the respective air duct, and each air duct of the first and the third air ducts having a mass flow sensor for measuring a mass of the air flowing through the air duct, and wherein the second air duct is devoid of a mass flow sensor.

2. A method for diagnosing an air supply, comprising:

providing an air supply to an internal combustion engine which has at least one cylinder and a heater of an exhaust system, the air supply including:

a first air duct configured to supply air to the at least one cylinder of the internal combustion engine for operating the internal combustion engine; and a second air duct configured to supply air to a heater configured to heat an exhaust gas system of the internal combustion engine, wherein the first and second air ducts are connected to an air filter by a third air duct, for providing filtered ambient air to the internal combustion engine, each respective air duct of the first and the second air ducts having at least one control element for controlling a quantity of air flowing through the respective air duct, and each air duct of the first and the third air ducts having a mass flow sensor for measuring a mass of the air flowing through the air duct, and wherein the second air duct is devoid of a mass flow sensor.

3. The method according to claim 2, further comprising:

in a first operating phase of the air supply, closing the control element in the first air duct so that no air flows through the first air duct, and controlling the control element in the second air duct such that air flows through the second air duct for operation of the heater, wherein the control element in the second air duct including an air pump and a valve, and the controlling of the control element in the second air duct includes controlling the air pump and opening the valve; and for the diagnosis, comparing a mass flow through the third air duct to an expected value which results from the control of the air pump and the opening of the valve.

4. The method according to claim 2, further comprising:

in a first operating phase of the air supply, closing the control element in the first air duct so that no air flows through the first air duct, controlling the control element in the second air duct such that air for operation of the heater flows through the second air duct, wherein the control element in the second air duct including an air pump and a valve, and the controlling of the control element in the second air duct includes controlling the air pump and opening the valve; and for the diagnosis, comparing a pressure signal in the first or third air duct to an expected value which results from the control of the air pump and the opening of the valve.

5. The method according to claim 2, further comprising:

in a first operating phase of the air supply, closing the control element in the first air duct so that no air flows through the first air duct, and controlling the control element in the second air duct such that air for operation of the heater flows through the second air duct, wherein the control element in the second air duct including an air pump and a valve, and the controlling of the control element in the second air duct includes controlling the air pump and opening the valve; and for the diagnosis, measuring a mass flow in the first air duct, and detecting a fault when a mass flow is measured in the first air duct despite the closed control element in the first air duct.

6. The method according to claim 2, further comprising:

in a first operating phase of the air supply, closing the control element in the first air duct so that no air flows through the first air duct, controlling the control element in the second air duct such that air for operation of the heater flows through the second air duct; and measuring, downstream of the heater, an oxygen content in the exhaust gas of the heater, and comparing the measured oxygen content to an expected value for the diagnosis.

7. The method according to claim 2, further comprising:

in a second operating phase of the air supply, opening the control element in the first air duct so that air flows through the first air duct to the at least one cylinder, and controlling the control element in the second air duct such that air for operation of the heater flows through the second air duct due to an air pump of the control element in the second air duct being switched on and a valve of the control element in the second air duct being open;

ascertaining a mass flow through the second air duct by subtracting a mass flow through the first air duct from a mass flow through the third air duct; and comparing the mass flows through the first and second air ducts to expected values ascertained from operating data of the at least one cylinder and the control elements in the first and second air ducts.

8. The method according to claim 2, further comprising:

in a third operating phase of the air supply, opening the control element in the first air duct so that air flows through the first air duct to the at least one cylinder, and controlling the control element in the second air duct such that no air for operation of the heater flows through the second air duct due to an air pump of the control element in the second air duct being switched off and a valve of the control element in the second air duct being closed; and for the diagnosis, comparing a mass flow through the first air duct to a mass flow through the third air duct.

9. The method according to claim 2, further comprising:

in a third operating phase of the air supply, opening the control element in the first air duct so that air flows through the first air duct to the at least one cylinder, and controlling the control element in the second air duct such that no air for operation of the heater flows through the second air duct due to an air pump of the control element in the second air duct being switched off and a valve of the control element in the second air duct being closed; and for the diagnosis, comparing a mass flow through the first air duct to an expected value for the mass flow in the first air duct, which expected value results from operating parameters of the at least one cylinder including a rotational speed and load of the internal combustion engine, and from operating data of a throttle valve of the control element in the first air duct.

10. A device for diagnosing an air supply an air supply to an internal combustion engine which has at least one cylinder and a heater of an exhaust system, the air supply including:

a first air duct configured to supply air to the at least one cylinder of the internal combustion engine for operating the internal combustion engine; and a second air duct configured to supply air to a heater configured to heat an exhaust gas system of the internal combustion engine, wherein the first and second air ducts are connected to an air filter by a third air duct, for providing filtered ambient air to the internal combustion engine, each respective air duct of the first and the second air ducts having at least one control element for controlling a quantity of air flowing through the respective air duct, and each air duct of the first and the third air ducts having a mass flow sensor for measuring a mass of the air flowing through the air duct, and wherein the second air duct is devoid of a mass flow sensor;

wherein the device is configured to control and diagnose the air supply.

11. The device according to claim 10, wherein, for diagnosing the air supply, in a first operating phase of the air supply in which the control element in the first air duct is closed so that no air flows through the first air duct, the control element in the second air duct is controlled such that air for operation of the heater flows through the second air duct, wherein the control element in the second air duct includes an air pump and a valve, and wherein the control of the control element in the second air duct includes controlling the air pump and opening the valve; and wherein an arrangement is provided which, for the diagnosis, compares a mass flow through the third air duct to an expected value which results from the control of the air pump and from the opening of the valve.

12. The device according to claim 10, wherein, for diagnosing the air supply, in a first operating phase of the air supply in which the control element in the first air duct is closed so that no air flows through the first air duct, the control element in the second air duct is controlled such that air for operation of the heater flows through the second air duct, wherein the control element in the second air duct includes an air pump and a valve, and wherein the control of the control element in the second air duct includes controlling the air pump and opening the valve; and an arrangement is provided which, for the diagnosis, compares a pressure signal in the first or third air duct to an expected value which results from the control of the air pump and from the opening of the valve.

13. The device according to claim 10, wherein, for diagnosing the air supply, in a first operating phase of the air supply in which the control element in the first air duct is closed so that no air flows through the first air duct, the control element in the second air duct is controlled such that air for operation of the heater flows through the second air duct, and an arrangement is provided which, for the diagnosis, measures a mass flow in the first air duct and detects a fault when a mass flow is measured in the first air duct despite the closed control element.

14. The device according to claim 10, wherein, for diagnosing the air supply, in a first operating phase of the air supply in which the control element in the first air duct is closed so that no air flows through the first air duct, the control element in the second air duct is controlled such that air for operation of the heater flows through the second air duct, and wherein an arrangement is provided, downstream of the heater, which measures an oxygen content in exhaust gas of the heater and compares the measured oxygen content to an expected value for the diagnosis.

15. The device according to claim 10, wherein, for diagnosing the air supply, in a second operating phase of the air supply in which the control element in the first air duct is open so that air flows through the first air duct to the at least one cylinder, the control element in the second air duct is controlled such that air for the operation of the heater flows through the second air duct due to an air pump of the control element being switched on and a valve of the control element being open, and wherein an arrangement is provided which is used to subtract a mass flow through the first air duct from a mass flow through the third air duct to ascertain a mass flow through the second air duct, and, for the diagnosis, compare the mass flows through the first and second air ducts to expected values ascertained from operating data of the at least one cylinder and of the control elements in the first and second air ducts.

16. The device according to claim 10, wherein, for diagnosing the air supply, in a third operating phase of the air supply in which the control element in the first air duct is open so that air flows through the first air duct to the at least one cylinder, the control element in the second air duct is controlled such that no air for the operation of the heater flows through the second air duct due to an air pump of the control element being switched off and a valve of the control element being closed, and wherein an arrangement is provided for the diagnosis which compares a mass flow through the first air duct to a mass flow through the third air duct.

17. The device according to claim 10, wherein, for diagnosing the air supply, in a third operating phase of the air supply in which the control element in the first air duct is open so that air flows through the first air duct to the at least one cylinder, the control element in the second air duct is controlled such that no air for the operation of the heater flows through the second air duct due to an air pump of the control element being switched off and a valve of the control element being closed, and wherein an arrangement is provided for the diagnosis which compares a mass flow through the first air duct to an expected value for the mass flow in the first air duct, the expected value resulting from operating parameters of the at least one cylinder including a rotational speed and load of the internal combustion engine, and from operating data of the throttle valve of the control element in the first air duct.

* * * * *